US008678866B2

(12) United States Patent
Hiraishi

(10) Patent No.: US 8,678,866 B2
(45) Date of Patent: Mar. 25, 2014

(54) LANCE OF A CONNECTOR HAVING TWO CONTACT PORTIONS

(75) Inventor: Takumi Hiraishi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 49 days.

(21) Appl. No.: 13/484,781

(22) Filed: May 31, 2012

(65) Prior Publication Data

US 2012/0309219 A1 Dec. 6, 2012

(30) Foreign Application Priority Data

Jun. 2, 2011 (JP) ..... 2011-124438

(51) Int. Cl.
*H01R 13/514* (2006.01)

(52) U.S. Cl.
USPC ..... 439/752; 439/595

(58) Field of Classification Search
USPC ..... 439/352, 752, 595, 752.5
See application file for complete search history.

(56) References Cited

U.S. PATENT DOCUMENTS 5,716,232 A * 2/1998 Endo et al. ..... 439/595
5,820,411 A 10/1998 Okabe
6,626,701 B2 * 9/2003 Yoshida et al. ..... 439/595
7,867,029 B2 * 1/2011 Takahashi et al. ..... 439/595
8,523,594 B2 * 9/2013 Takeda et al. ..... 439/352
2003/0157835 A1 8/2003 Ishikawa et al.
2012/0034805 A1 * 2/2012 Takeda et al. ..... 439/352

FOREIGN PATENT DOCUMENTS

JP 2009-231077 10/2009

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A retainer (50) is mounted into a housing (20). The retainer (50) can be inserted into a deformation space (26) for the locking lance (25) when a terminal fitting (80) is inserted properly into a cavity (22) and thus restricts deformation of a locking lance (25) to lock the locking lance (25). On the other hand, the retainer (50) contacts the resiliently deformed locking lance (25) to prevent any further insertion of the retainer (50) when the terminal fitting (80) is in an insufficiently inserted state in the cavity (22). First and second contact portions (31, 32) are provided at different positions of the locking lance (25) with which the retainer (50) contacts the first contact portions (31) when the terminal fitting (80) is inserted insufficiently in the cavity (22). A jig (100) contacts the second contact portion (32) to release a locked state of the terminal fitting (80).

12 Claims, 8 Drawing Sheets

LANCE OF A CONNECTOR HAVING TWO CONTACT PORTIONS

BACKGROUND OF THE INVENTION

1. Field of the Invention

The invention relates to a connector.

2. Description of the Related Art

Japanese Unexamined Patent Publication No. 2009-231077 discloses a connector with a housing that has a cavity, a terminal fitting inserted into the cavity and a retainer mounted on the front of the housing. A locking lance projects forward at an inner surface of the cavity of the housing and locks the properly inserted terminal fitting in the cavity. The retainer initially is at a partial locking position where the terminal fitting can be inserted into the cavity. However, the retainer can be moved to a full locking position where part of the retainer enters a deformation space for the locking lance. Thus, the retainer at the full locking position prevents deformation of the locking lance, thereby doubly locking the terminal fitting. The locking lance is left resiliently deformed if the terminal fitting is not inserted sufficiently into the cavity. Hence, the retainer contacts the leading end of the locking lance and cannot move to the full locking position. As a result, an insufficiently inserted state of the terminal fitting can be detected based on whether or not the retainer can be moved. The retainer can be retracted from the deformation space. A jig then can be inserted into the deformation space and can press the leading end of the locking lance down into the deformation space for releasing a locked state between the locking lance and the terminal fitting.

The jig is brought into contact with a leading end of the locking lance of the above-described connector to release the locked state of the terminal fitting and the retainer contacts the leading end of the locking lance when the terminal fitting is inserted insufficiently. The jig and the retainer contact the same position on the leading end of the locking lance. Thus, for example, the retainer may collide with and damage the leading end of the locking lance. The jig then may be unable to catch the damaged leading end of the locking lance properly for releasing the locked state between the locking lance and the terminal fitting. On the other hand, the jig may collide with and damage the leading end portion of the locking lance. As a result, the retainer may not properly contact the damaged leading end portion of the locking lance and may be unable to detect the insufficiently inserted state of the terminal fitting.

The invention was completed in view of the above and an object thereof is to assure a function of detecting an insufficiently inserted state of a terminal fitting and a function of releasing a locked state between a locking lance and the terminal fitting.

SUMMARY OF THE INVENTION

The invention relates to a connector with a housing that has at least one cavity, at least one terminal fitting to be inserted into the cavity, at least one resiliently deformable locking lance projecting at the cavity for locking the terminal fitting and a retainer to be mounted into the housing. The retainer is configured to be inserted into a deformation space for the locking lance when the terminal fitting is inserted properly in the cavity. Thus, the retainer restricts deformation of the locking lance and retains the terminal fitting. On the other hand, the retainer contacts the resiliently deformed locking lance to prevent any further insertion of the retainer when the terminal fitting is inserted insufficiently in the cavity. First and second contact portions are provided at different positions on the locking lance. The retainer contacts the first contact portion when the terminal fitting is inserted insufficiently in the cavity and a jig contacts the second contact portion for releasing a locked state of the terminal fitting.

The jig can contact the second contact portion to fulfill an unlocking function properly even if the first contact portion is damaged. Further, the retainer can contact the first contact portion to fulfill an insufficient insertion detecting function properly even if the second contact portion is damaged. Therefore, both the unlocking function and the insufficient insertion detecting function are prevented from being impaired.

The first and second contact portions preferably are shifted from each other in a width direction substantially perpendicular to a mounting direction of the retainer into the housing. Thus, the retainer and the jig reliably contact the first and second contact portions in the mounting direction.

The retainer preferably includes an insufficient insertion detecting portion that contacts the first contact portion when the terminal fitting is inserted insufficiently in the cavity and a deformation restricting portion that faces the locking lance in a resilient deforming direction of the locking lance when the terminal fitting is inserted properly.

The insufficient insertion detecting portion and the deformation restricting portion preferably are shifted from each other along or in the mounting direction into the housing. Thus, the simultaneous contact of the insufficient insertion detecting portion and the deformation restricting portion with the locking lance is avoided.

Each of the first contact portion and the insufficient insertion detecting portion has a contact surface inclined with respect to the mounting direction into the housing. Thus, the contact surfaces can slide on each other to guide resilient deformation of the locking lance and prevent the retainer from being erroneously inserted into the deformation space for the locking lance when the terminal fitting is inserted insufficiently. Therefore, reliable detection of the insufficiently inserted state of the terminal fitting is assured.

The insufficient insertion detecting portion preferably is provided before the deformation restricting portion in the mounting direction into the housing. Thus, whether the terminal fitting is inserted insufficiently is known at an early stage of the mounting process. On the other hand, the deformation restricting portion reliably restricts resilient deformation of the locking lance at a final stage of the mounting process.

The second contact portion preferably is in a widthwise intermediate part of the locking lance. The insufficient insertion detecting portion is on a lateral part of the retainer, and a widthwise intermediate part of the leading end of the retainer is cut to form a recess for avoiding interference with the second contact portion.

The insufficient insertion detecting portion preferably is provided on each of substantially opposite widthwise sides of a leading end portion of the retainer. Thus, the retainer will not interfere with the second contact portion and reliability in releasing the locked state of the terminal fitting by the jig is improved further.

A front surface of the first contact portion preferably defines a first contact surface that can contact the retainer and a front surface of the second contact portion preferably defines a second contact portion that can contact the jig.

Angles of inclination of the first and second contact surfaces preferably are substantially equal.

At least one jig insertion hole is formed at a position of an outer surface of the housing facing the second contact portion and can receive the jig. The width of the jig insertion hole preferably substantially equals the width of the second contact portion. Thus, the jig inserted into the jig insertion hole will not interfere with the first contact portion and the insufficient insertion of the terminal fitting is detected reliably by the retainer.

These and other objects, features and advantages of the invention will become more apparent upon reading the following detailed description and accompanying drawings.

DETAILED DESCRIPTION OF THE PREFERRED EMBODIMENT

Figure 1:
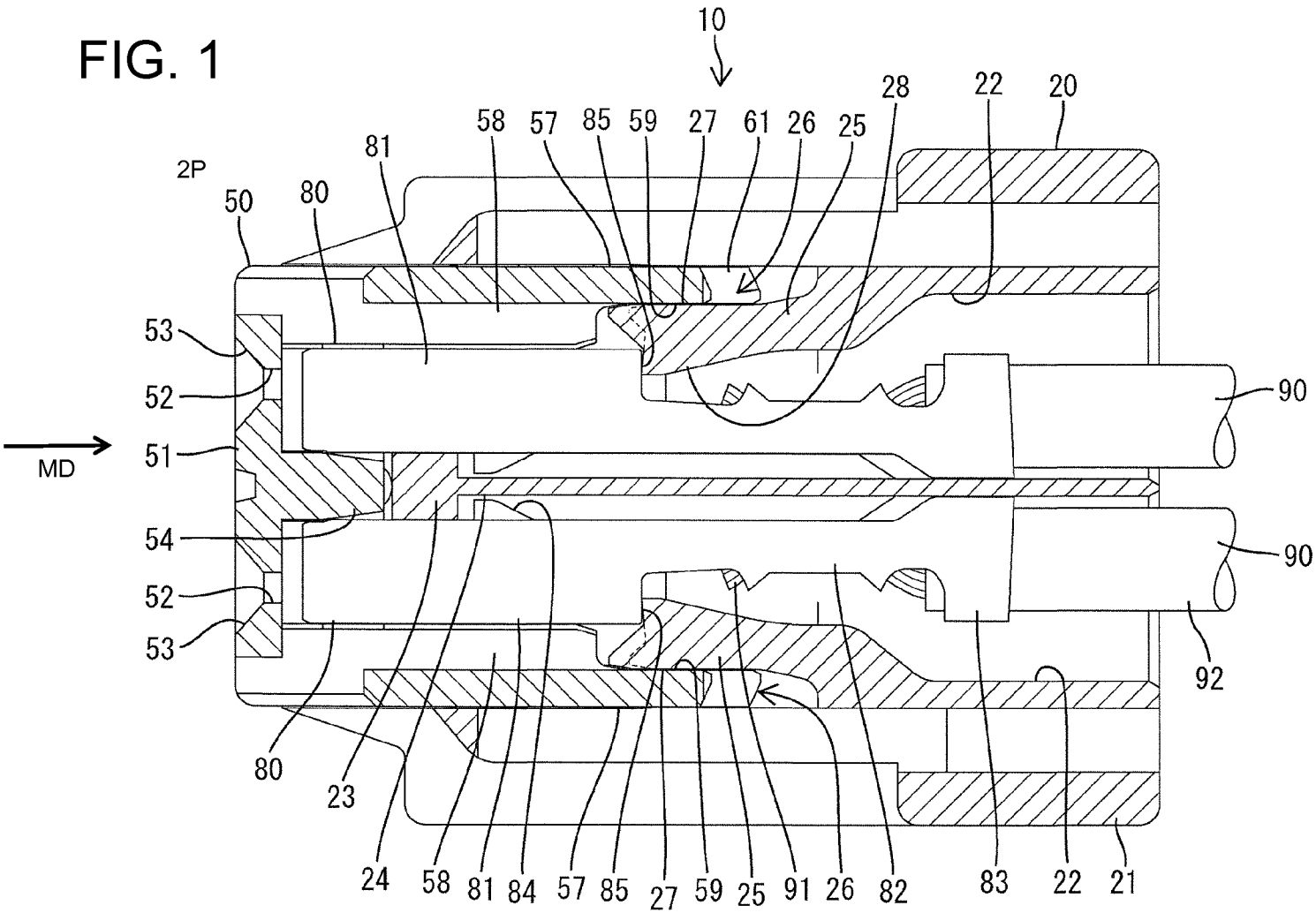
FIG. 1 is a section of a connector according to one embodiment of the invention.
Figure 2:
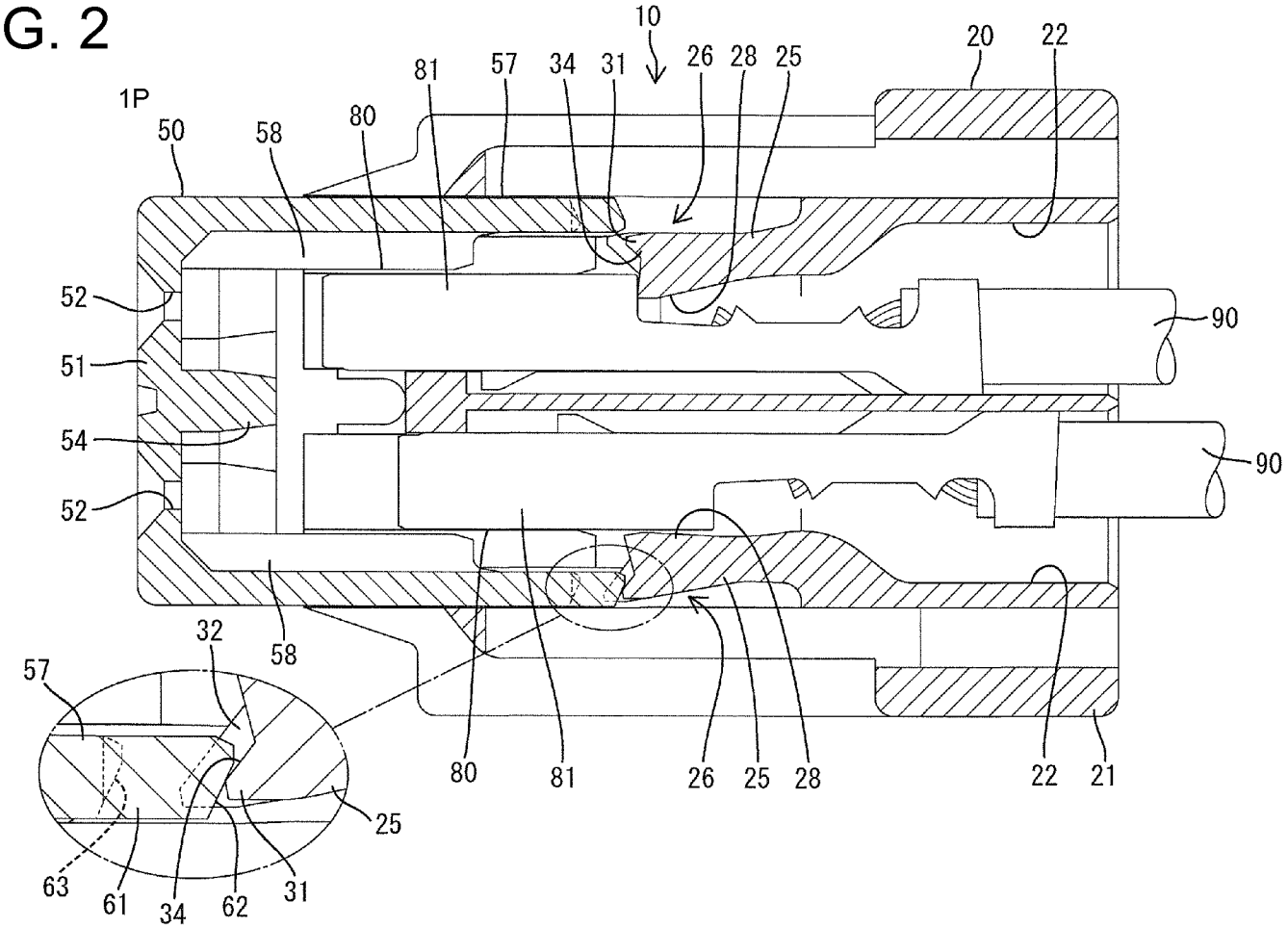
FIG. 2 is a section showing a retainer in contact with first contact portions of a locking lance when a terminal fitting is not inserted sufficiently in a cavity.
Figure 3:
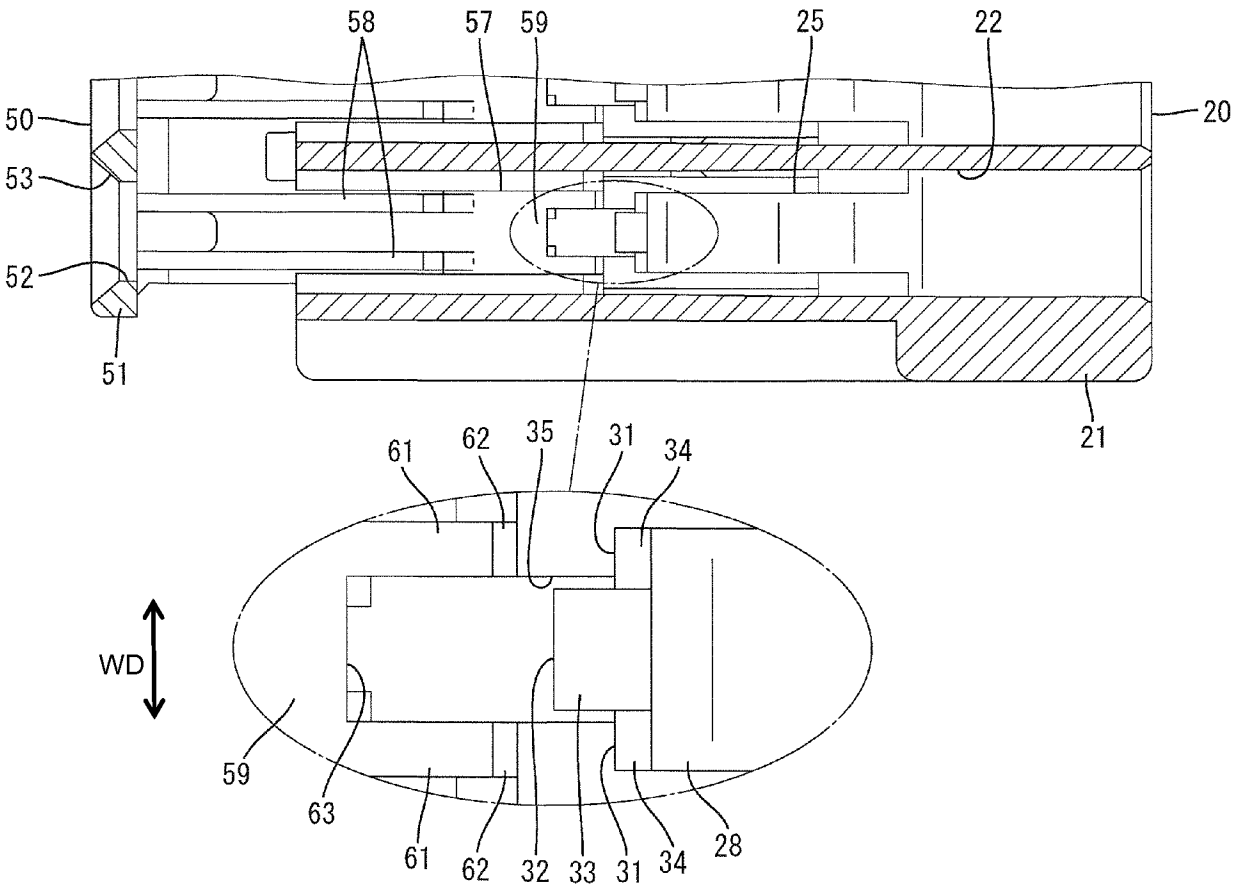
FIG. 3 is a plan view in section of the locking lance in the cavity of the housing when the retainer is at a partial locking position.

A connector 10 according to this embodiment is identified by the number 10 in FIGS. 1 to 3. The connector 10 has a housing 20, a retainer 50 to be mounted into the housing 10 and terminal fittings 80 to be accommodated in the housing 20. The housing 20 is connectable to an unillustrated housing, and the terminal fittings 80 are electrically connectable to respective unillustrated mating terminal fittings mounted in the mating housing as the housings are connected. In the following description, an end to be connected to the mating housing is referred to as a front end concerning forward and backward directions.

The terminal fitting 80 is formed by bending, folding and/or embossing a unitary electrically conductive metal plate and, as shown in FIG. 1, includes a terminal main body 81 in the form of a substantially rectangular tube and a wire connection portion behind and connected to the terminal main body 81. The wire connection portion comprises a wire barrel 82 to be crimped, bent or folded into connection with a core 91 at an end of a wire 90, and at least one insulation barrel 83 to be crimped, bent or folded into connection with an insulation coating 92 of the wire 90. The mating terminal fitting is to be inserted into the interior of the terminal main body 81 for connection. A stabilizer 84 projects on the outer surface of the terminal main body 81. Further, an engaging portion 85 is formed at the rear end edge of the terminal main body 81.

Figure 4:
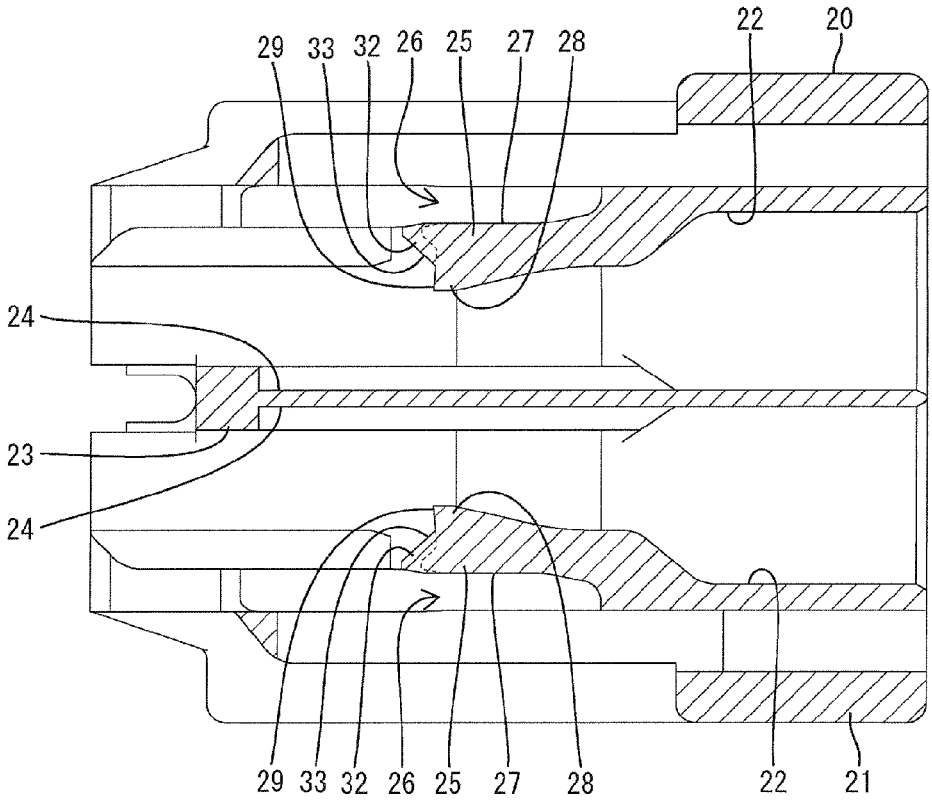
FIG. 4 is a section of the connector housing.

The housing 20 is made e.g. of synthetic resin and, as shown in FIG. 4, includes a substantially block-shaped housing main body 21. Cavities 22 are formed in a width direction and extend in forward and backward directions in each of two levels in a height direction. The terminal fitting 80 is to be inserted into each cavity 22 from behind. A partition wall 23 partitions between the cavities 22 that are adjacent in the height direction. Guiding grooves 24 are formed in upper and lower surfaces of the partition wall 23 for receiving the stabilizer 83. The guiding grooves 24 extend in forward and backward directions and are open on the rear surface of the housing main body 21. The stabilizer 84 can be inserted into the guiding groove 24 when the terminal fitting 80 is in a proper insertion posture to guide insertion of the terminal fitting 80. On the other hand, the stabilizer 84 cannot be inserted into the guiding groove 24 when the terminal fitting 80 is in an improper orientation, thereby preventing insertion of the terminal fitting 80.

Locking lances 25 are provided at the inner wall of each cavity 22 of the housing main body 21. The locking lance 25 is cantilevered forward from the inner wall of the cavity 22. The respective locking lances 25 are connected to the upper walls of the cavities 22 in the upper level and the lower walls of the cavities 22 in the lower level and are arranged back-to-back in the height direction. There is no front wall at the front end of the housing main body 21, and leading ends of the locking lances 25 can be seen through a front end opening of the housing main body 21 when the retainer 50 is not mounted.

A deformation space 26 for the locking lance 25 is provided adjacent to the cavity 22 and the locking lance 25, as shown in FIG. 4. The locking lance 25 is resiliently deformable into the deformation space 26 in the height direction with the base end of the locking lance 25 as a support. The locking lance 25 has a substantially flat restriction surface 27 that faces the deformation space 26. The restriction surface 27 can come into contact with the retainer 50.

A locking projection 28 is formed on the leading end portion of the locking lance 25 and projects into the cavity 22, as shown in FIG. 4. A substantially vertical locking surface 29 is formed on the front of the locking projection 28. The locking surface 29 is arranged substantially perpendicular to the inserting direction of the terminal fitting 80 into the cavity 22. First and second contact portions 31, 32 are arranged in the width direction WD on the leading end portion of the locking lance 25, as shown in FIG. 3, and can come into contact with the retainer 50 and a jig 100 (see FIG. 7). The first and second contact portions 31, 32 project unitarily forward from an outer side of the locking surface 29 of the locking projection 28.

The second contact portion 32 projects in a widthwise central part of the locking surface 29 of the locking projection 28. The front surface of the second contact portion 32 defines a second contact surface 33 that can contact the jig 100. The second contact surface 33 is slanted to incline inward toward the rear side as shown in FIG. 4.

As shown in FIG. 3, two first contact portions 31 project adjacent to the second contact portion 32. The first contact portions 31 are at opposite widthwise sides of the second contact portion 32 and on substantially opposite widthwise ends of the locking surface 29 of the locking projection 28. The front surfaces of the first contact portions 31 define first contact surfaces 34 that can contact the retainer 50. The first contact surfaces 34 are slanted to incline inwardly toward the rear, as shown in FIG. 2.

A projecting amount of the second contact portion 32 is larger than a projecting amount of the first contact portions 31 and the second contact surface 33 is located before the first contact surfaces 34. The first and second contact portions 31, 32 are connected via steps. Further, an angle of inclination of the first contact surfaces 34 with respect to forward and backward directions is substantially equal to the angle of inclination of the second contact surface 33.

Figure 7:
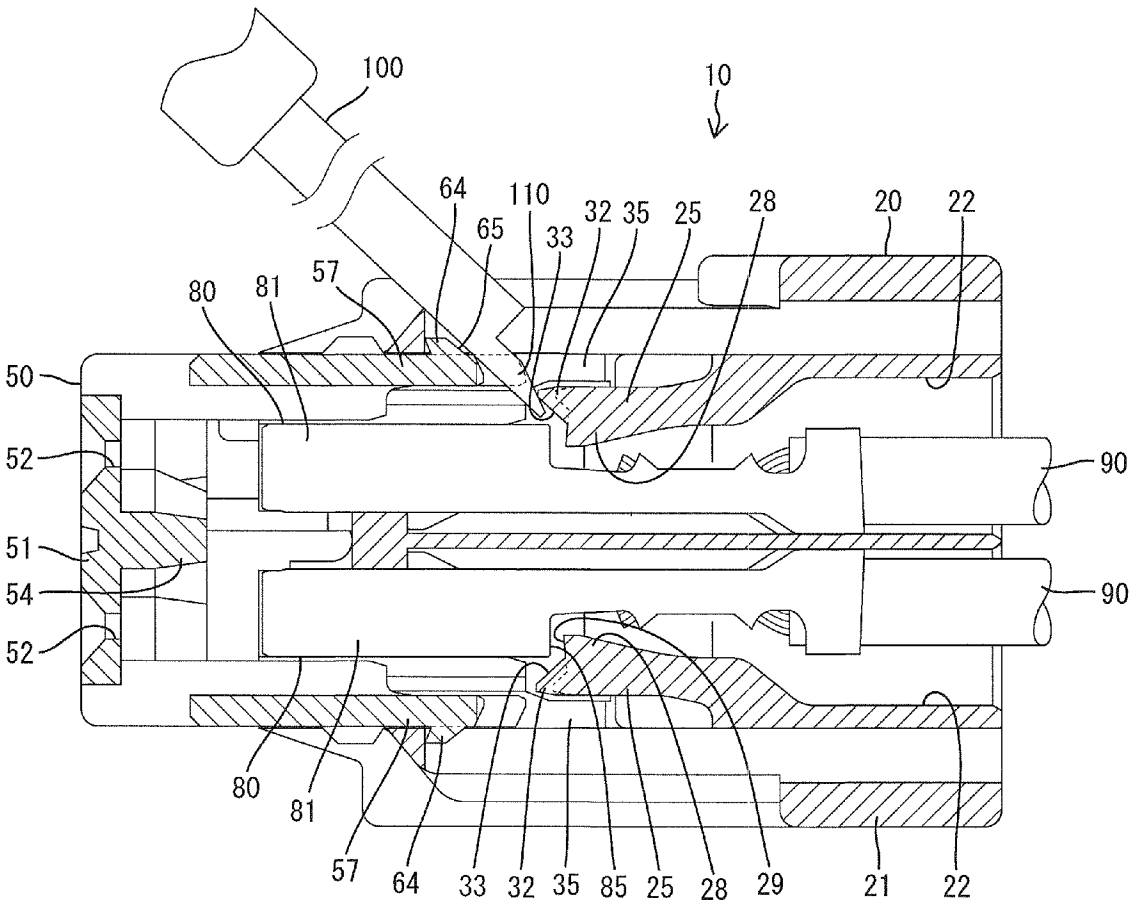
FIG. 7 is a section showing a jig in contact with a second contact portion of the locking lance in releasing the locking lance from the terminal fitting.

Jig insertion holes 35 are formed on upper and lower outer surfaces of the housing main body 21 at positions facing the second contact portions 32 of the locking lances 25, as shown in FIG. 7. The jig insertion holes 35 open forward and front end openings of the jig insertion holes 35 are at least partly closed by the retainer 50. Further, as shown in FIG. 3, the width of the jig insertion holes 35 is substantially equal to the width of the second contact portions 32.

Figure 5:
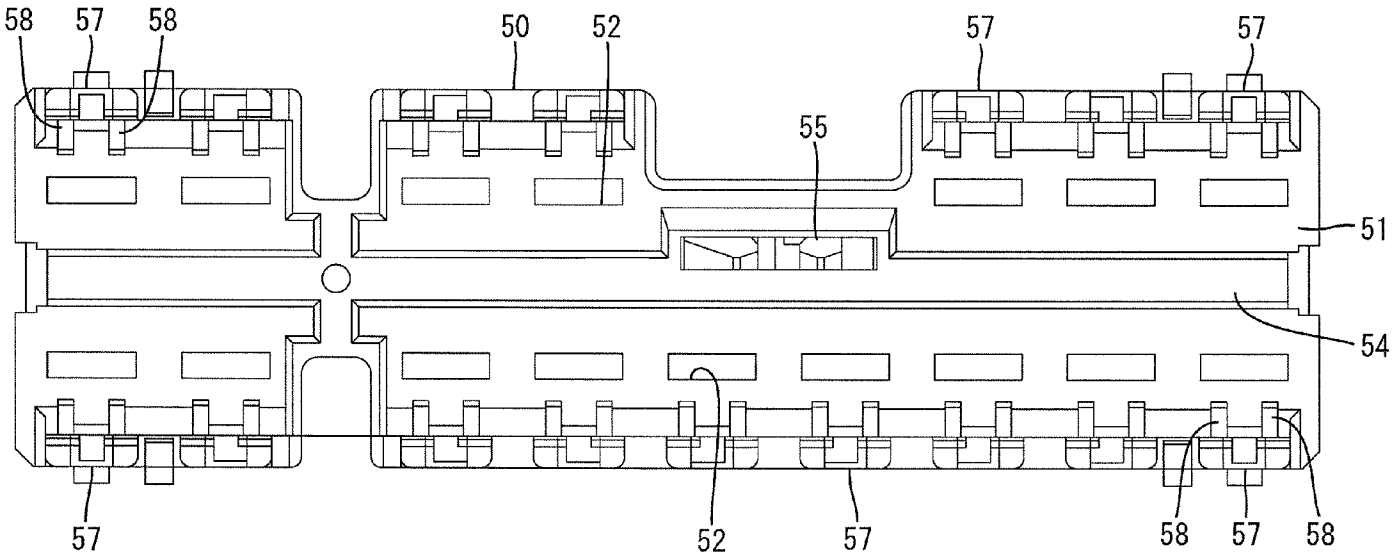
FIG. 5 is a rear view of the retainer.

The retainer 50 is made e.g. of synthetic resin and, as shown in FIGS. 1 and 5, includes a flat plate-shaped front wall 51 that can at least partly close a front end opening of the housing main body 21. The front wall 51 has wide slit-shaped tab insertion holes 52 at positions facing the respective cavities 22. As shown in FIG. 1, tapered guides 53 are formed on the front surface of the front wall 51 at the opening edges of the tab insertion holes 52 for guiding male tabs (not shown) of the mating terminal fittings into the respective cavities 22. An auxiliary partition wall 54 project back from the rear surface of the front wall 51 at a substantially central part of the front wall 51 in the height direction. The auxiliary partition wall 54 extends in the width direction WD and is arranged to be right before the partition walls 23 of the housing main body 21 at a full locking position 2P, as shown in FIG. 1.

Figure 6:
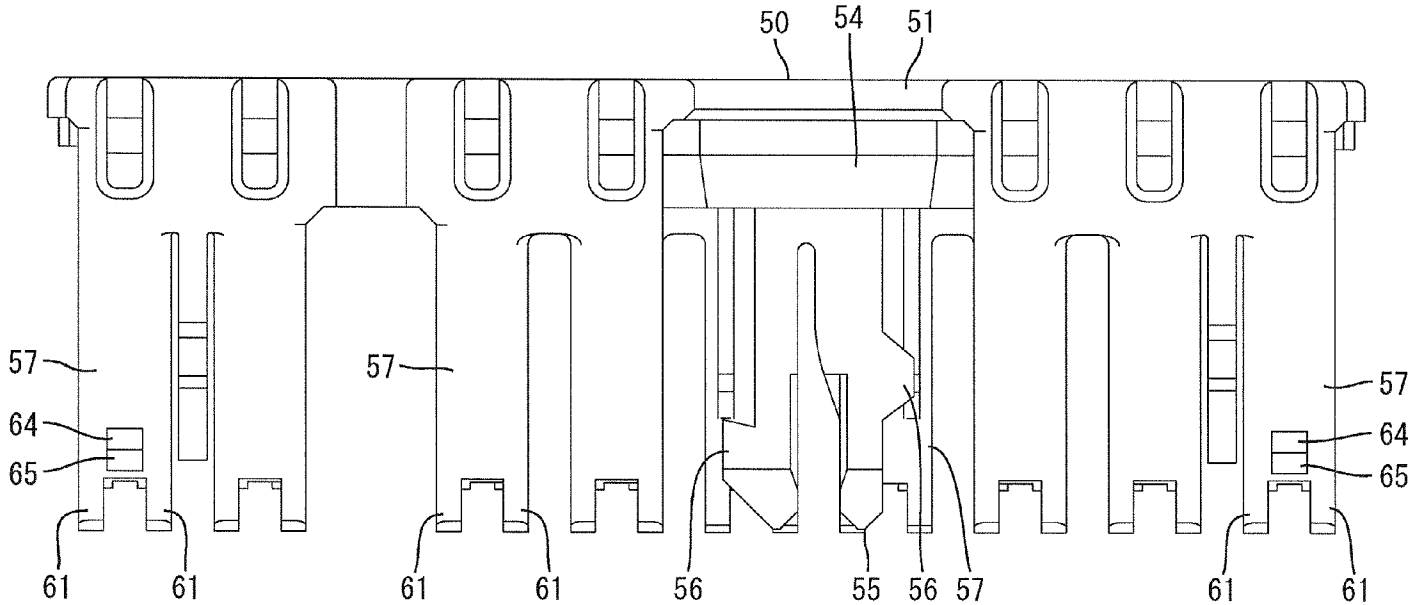
FIG. 6 is a plan view of the retainer.

As shown in FIG. 6, a lock 55 projects back from the rear surface of the front wall portion 51. The lock 55 is forked to have two divided parts, and a projection 56 is provided on a leading end side of each divided part. The projections 56 of the lock 55 are engaged with engaging portions (not shown) of the housing main body 21 when the retainer 50 is mounted into the housing 20 so that the retainer 50 can be held at a partial locking position 1P and the full locking position 2P with respect to the housing main body 21. The front wall 51 is spaced forward from the front end of the housing main body 21 at the partial locking position 1 P, as shown in FIG. 2, but is on the front end of the housing main body 21 at the full locking position 2P as shown in FIG. 1. A locked state between the projections 56 of the lock 55 and the engaging portions is released when the retainer 50 is pushed back from the partial locking position 1P and the retainer 50 is allowed to move back toward the full locking position 2P.

As shown in FIGS. 5 and 6, lance engaging pieces 57 project back at positions corresponding to each cavity 22 on both end portions of the rear surface of the front wall 51 in the height direction. Each lance engaging piece 57 is a plate extending in forward and backward directions and is insertable into the deformation space 26 for the locking lance 25, and the front end of each lance engaging piece 57 defines the front end of the jig insertion hole 35 (see FIG. 2). Further, as shown in FIGS. 3 and 5, ribs 58 project from the inner surface of the lance engaging piece 57 toward the cavity 22 and are spaced apart in the width direction WD. Each rib 58 extends in forward and backward directions and can contact the outer surface of the terminal main body 81. Thus, the terminal main body 81 is sandwiched between the ribs 58 and the auxiliary partition wall 54 to prevent loose movements in the height direction.

A substantially flat deformation restricting portion 59 is provided adjacent and behind the rear ends of the ribs 58 in a widthwise central part of the inner surface of the lance engaging piece 57, as shown in FIG. 3. The deformation restricting portion 59 of the lance engaging piece 57 can be held in surface contact with the restriction surface 27 of the locking lance 25 at the full locking position 2P, as shown in FIG. 1.

Two insufficient insertion detecting portions 61 are spaced apart in the width direction WD at positions adjacent and before the deformation restricting portion 59 on a leading end portion of the lance engaging piece 57 as shown in FIG. 3. The leading end surfaces of the insufficient insertion detecting portions 61 define retainer-side contact surfaces 62 that are inclined out toward the front. The retainer-side contact surfaces 62 of the insufficient insertion detecting portions 61 can contact the first contact surfaces 34 of the locking lance 25.

Part of the leading end portion of the lance engaging piece 57 between the insufficient insertion detecting portions 61 is cut to form a recess 63, as shown in FIG. 3. The recess 63 is open at the leading end of the lance engaging piece 57 and the second contact portion 32 of the locking lance 25 is insertable therein. A guiding projection 64 is provided on the outer surface of the leading end portion of the lance engaging piece 57, as shown in FIG. 6. The guiding projection 64 has at least one guiding slant surface 65 inclined toward the jig insertion hole 35, as shown in FIG. 7.

The retainer 50 is mounted into the housing main body 21 of the housing 20 and is held at the partial locking position 1 P. The terminal fittings 80 then are inserted into the cavities 22 of the housing main body 21 from behind and along the inserting direction. In the process of inserting the terminal fitting 80, the locking lance 25 is deformed resiliently in a deformation direction that crosses the inserting direction and enters the deformation space 26. The locking lance 25 resiliently restores when the terminal fitting 80 is inserted properly and the locking surface 29 of the locking projection 28 engages the engaging portion 85 of the terminal main body 81 from behind. In this way, the terminal fitting 80 is prevented from coming out backward from the cavity 22. During this time, the lance engaging pieces 57 of the retainer 50 are before the deformation spaces 26 to allow resilient deformation of the locking lances 25.

The retainer 50 subsequently is pushed back in the mounting direction MD to reach the full locking position 2P, as shown in FIG. 1. The lance engaging pieces 57 then enter the deformation spaces 26 and the deformation restricting portions 59 of the lance engaging pieces 57 contact the restriction surfaces 27 of the locking lances 25 to prevent resilient deformation of the locking lances 25 into the deformation spaces 26. In this way, the terminal fittings 80 are locked doubly by the locking lances 25 and the retainer 50.

A terminal fitting 80 may be left insufficiently inserted without being inserted to a proper depth in the cavity 22, as shown in FIG. 2. Thus, the locking lance 25 is left resiliently deformed in the deformation space 26. An attempt may be made to push the retainer 50 toward the full locking position 2P in this state. However, the insufficient insertion detecting portions 61 of the lance engaging piece 57 contact the first contact portions 31 of the locking lance 25 to prevent further insertion of the retainer 50. At this time, the retainer-side contact surfaces 62 of the insufficient insertion detecting portions 61 slide on the first contact surfaces 34 of the first contact portions 31 and guide resilient deformation of the locking lance 25 into the deformation space 26. Accordingly, the insufficient insertion detecting portions 61 are kept in contact with the first contact portions 31 to indicate that the terminal fitting 80 is in the insufficiently inserted state in the cavity 22. Further, with the insufficient insertion detecting portions 61 held in contact with the first contact portions 31, the second contact portion 32 can escape into the recess 63 between the insufficient insertion detecting portions 61, thereby avoiding interference of the lance engaging piece 57 with the second contact portion 32.

The terminal fitting 80 may have to be pulled out of the cavity 22 of the housing 20 for maintenance or another reason. Thus, the retainer 50 is pulled back to the partial locking position 1P so that the locking lances 25 can be deformed resiliently. A leading end portion of the jig 100 then is inserted into the jig insertion hole 35, as shown in FIG. 7. More particularly, a substantially pointed operating portion 110 is formed on the leading end portion of the jig 100. The jig 100 smoothly enters the jig insertion hole 35 substantially along the guiding slant surface 65 of the guiding projection 64 and the operating portion 110 contacts the second contact portion 32 of the locking lance 25 substantially facing in its moving direction.

Figure 8:
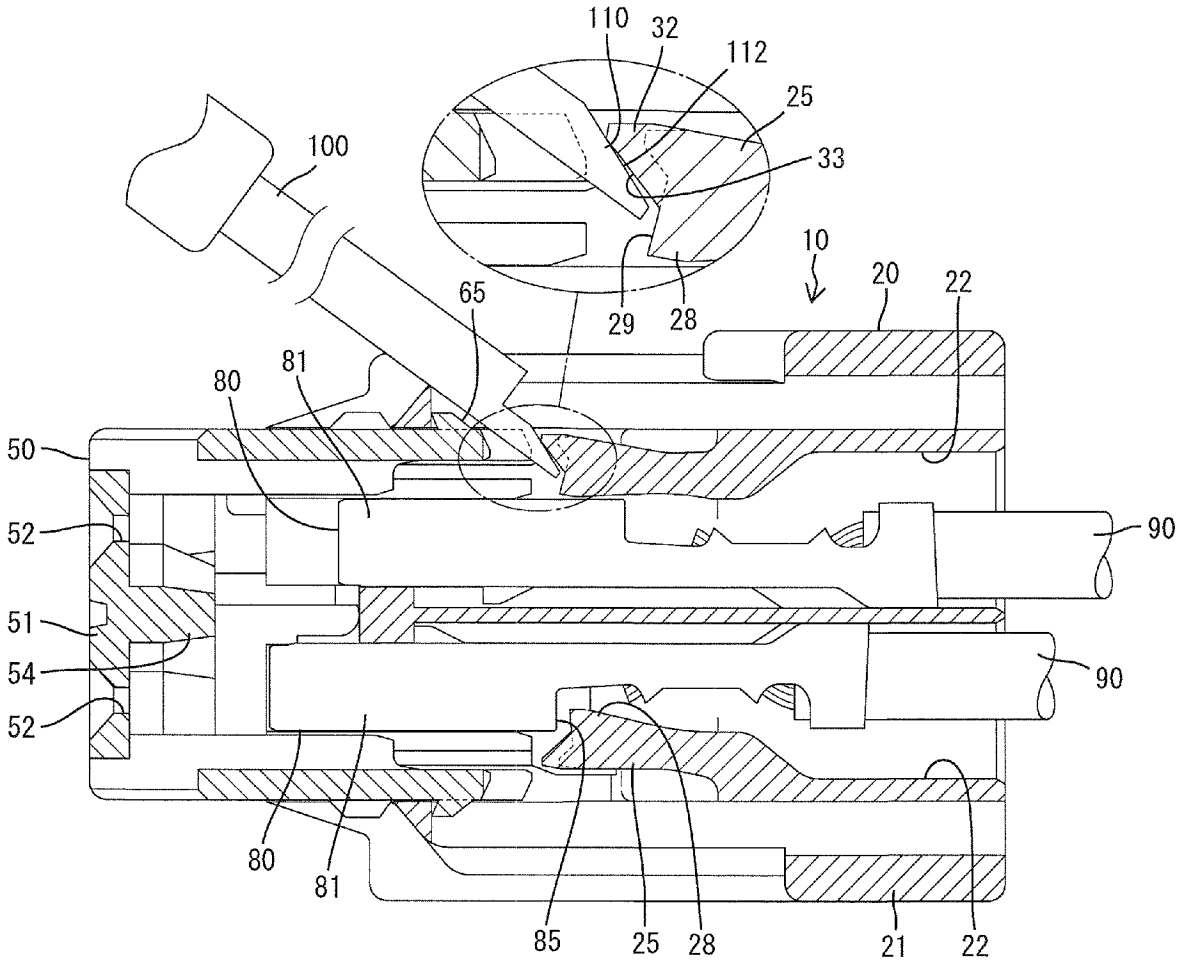
FIG. 8 is a section showing a state where the locked state between the locking lance and the terminal fitting is released.

As shown in FIG. 8, when it is tried to forcibly move the jig 100 along the guiding slant surface 65 while exerting a force, the second contact surface 33 of the second contact portion 32 contacts a slant surface 112 of the operating portion 110 and the locking lance 25 is deformed resiliently to enter the jig insertion hole 35. In this way, the locking projection 28 of the locking lance 25 is separated from the terminal main body 81 and the locked state between the locking lance 25 and the terminal fitting 80 is released. The terminal fitting 80 then can be pulled out of the cavity 22 by holding and pulling the wire 90 backward.

As described above, the retainer 50 contacts the first contact portions 31 of the resiliently deformed locking lance 25 if the terminal fitting 80 is in the insufficiently inserted state, as shown in FIG. 2, thereby preventing further insertion of the retainer 50 and indicating that the terminal fitting 80 is in the insufficiently inserted state. Further, the jig 100 can smoothly release the locked state between the terminal fitting 80 and the locking lance 25 by bringing the jig 100 into contact with the second contact portion 32 of the locking lance 25, as shown in FIG. 8. The first and second contact portions 31, 32 are at different positions. Thus, an unlocking function is fulfilled properly by the contact of the jig 100 with the second contact portions 32 even if the first contact portions 1 are damaged. Further, an insufficient insertion detecting function is fulfilled properly by the contact of the retainer 50 with the first contact portions 31 even if the second contact portion 32 is damaged. Therefore, both the unlocking function and the insufficient insertion detecting function are prevented from being impaired so that overall operability of the connector is improved.

The first and second contact portions 31, 32 are displaced from each other in the width direction WD. Thus, the retainer 50 and the jig 100 can reliably contact the first and second contact portions 31, 32.

The insufficient insertion detecting portions 61 and the deformation restricting portion 59 are shifted from each other on the retainer 50 in forward and backward directions (mounting direction MD into the housing 20). Thus, the deformation restricting portion 59 and the insufficient insertion detecting portions 61 of the retainer 50 will not simultaneously contact the locking lance 25.

The first contact portions 31 and the insufficient insertion detecting portions 61 have the first contact surfaces 34 and the retainer-side contact surfaces 62 inclined with respect to forward and backward directions. Thus, the first contact surfaces 34 and the retainer-side contact surfaces 62 slide on each other when the terminal fitting 80 is in the insufficiently inserted state. Accordingly, resilient deformation of the locking lance 25 is guided and the retainer 50 is prevented from being inserted erroneously into the deformation space 26 for the locking lance 25. Therefore, reliability in detecting the insufficiently inserted state of the terminal fitting 80 is improved further.

The insufficient insertion detecting portions 61 are provided before the deformation restricting portion 59 in the mounting direction MD into the housing 20. Thus, the insufficient insertion detecting portions 61 can detect the insufficiently inserted state of the terminal fitting 80 early in the mounting process and, on the other hand, resilient deformation of the locking lance 25 can be restricted reliably by the deformation restricting portion 59 at a final stage of the mounting process.

The widthwise central part of the leading end portion of the lance engaging portion 57 of the retainer 50 is cut to form the recess 63 for avoiding interference with the second contact portion 32. Thus, the contact of the leading end portion of the retainer 50 with the second contact portion 32 is avoided in detecting the insufficiently inserted state of the terminal fitting 80 and reliability in releasing the locked state of the terminal fitting 80 by the jig 100 is improved.

The jig insertion holes 35 are arranged on outer surfaces of the housing 20 to face the second contact portions 32 and the width of the jig insertion holes 35 substantially equals the width of the second contact portions 32. Thus, the jig 100 inserted into the jig insertion hole 35 will not interfere with the first contact portions 31 and the retainer 50 can detect the insufficiently inserted state of the terminal fitting 80 more reliably.

The invention is not limited to the above described embodiment. For example, the following embodiments also are included in the scope of the invention.

Contrary to the above embodiment, a first contact portion may be provided in the widthwise central or intermediate part of the leading end portion of the locking lance and one or more second contact portions may be provided adjacent thereto, particularly on the substantially opposite widthwise ends of the leading end portion of the locking lance.

The retainer may be a side retainer movable in the width direction.

The jig may be inserted into the cavity of the connector housing from front and brought into contact with the second contact portion of the locking lance.

The terminal fittings may be male terminal fittings with male tabs. In this case, the housing may be a male housing with a receptacle into which male the tabs project.

What is claimed is:

1. A connector, comprising:

at least one terminal fitting;

a housing including at least one cavity for receiving the terminal fitting, the housing having at least one resiliently deformable locking lance projecting at the cavity for locking and retaining the terminal fitting;

a retainer to be mounted into the housing, the retainer being configured to be inserted into a deformation space for the locking lance when the terminal fitting is inserted properly in the cavity for restricting deformation of the locking lance and locking the terminal fitting, the retainer contacting the resiliently deformed locking lance when the terminal fitting is in an insufficiently inserted state in the cavity to prevent any further insertion of the retainer; and at least one first contact portion and at least one second contact portion provided at different positions of the locking lance, the retainer contacting the first contact portion when the terminal fitting is in the insufficiently inserted state in the cavity and a jig contacting the second contact portion for releasing a locked state of the terminal fitting.

2. The connector of claim 1, wherein the first and second contact portions are shifted from each other in a direction perpendicular to a mounting direction of the retainer into the housing.

3. The connector of claim 2, wherein the retainer has an insufficient insertion detecting portion that contacts the first contact portion when the terminal fitting is insufficiently inserted in the cavity and a deformation restricting portion that substantially faces the locking lance in a resilient deforming direction of the locking lance when the terminal fitting is inserted properly in the cavity.

4. The connector of claim 3, wherein the insufficient insertion detecting portion and the deformation restricting portion are shifted from each other along the mounting direction into the housing.

5. The connector of claim 3, wherein the first contact portion and the insufficient insertion detecting portion have contact surfaces inclined with respect to the mounting direction into the housing.

6. The connector of claim 3, wherein the insufficient insertion detecting portion is provided before the deformation restricting portion in the mounting direction into the housing.

7. The connector of claim 3, wherein the second contact portion is provided in a widthwise central part of the locking lance, the insufficient insertion detecting portion is provided on a lateral part of the retainer, and a widthwise central part of a leading end portion of the retainer is cut to form a recess for avoiding interference with the second contact portion.

8. The connector of claim 7, wherein the insufficient insertion detecting portion is provided on each of substantially opposite widthwise sides of the leading end portion of the retainer.

9. The connector of claim 8, wherein a front surface of the first contact portion defines a first contact surface that can contact the retainer and wherein a front surface of the second contact portion defines a second contact surface that can contact the jig.

10. The connector of claim 9, wherein an angle of inclination of the first contact surface is substantially equal to an angle of inclination of the second contact surface.

11. The connector of claim 1, wherein at least one jig insertion hole is formed at a position of an outer surface of the housing substantially facing the second contact portion into which the jig can inserted.

12. The connector of claim 11, wherein a width of the jig insertion hole is substantially equal to a width of the second contact portion.

* * * * *